United States Patent [19]

James, Jr.

[11] Patent Number: 4,798,319

[45] Date of Patent: Jan. 17, 1989

[54] BALL CADDY

[76] Inventor: Virtious James, Jr., 1946 W. Romley, Phoenix, Ariz. 85041

[21] Appl. No.: 101,268

[22] Filed: Sep. 25, 1987

[51] Int. Cl.[4] ..... A45F 5/00

[52] U.S. Cl. ..... 224/251; 224/196; 224/253; 224/919

[58] Field of Search ..... 224/918, 919, 252, 253, 224/251, 242, 196, 235; 221/185; 220/305, 229; 206/315.9

[56] References Cited

U.S. PATENT DOCUMENTS

| | | | |
|---|---|---|---|
| 1,778,225 | 10/1930 | Morss | 224/919 X |
| 2,768,775 | 10/1956 | Houser | 224/196 X |
| 2,950,748 | 8/1960 | Olinghouse | 224/919 X |
| 3,263,806 | 8/1966 | Ring | 224/196 X |
| 3,281,013 | 10/1966 | Motard | 224/919 X |
| 3,315,402 | 4/1967 | Scott et al. | 220/229 X |
| 3,756,299 | 9/1973 | Simmons et al. | 224/919 X |
| 4,042,156 | 8/1977 | Knight | 224/253 |
| 4,299,345 | 11/1981 | Lanzl | 224/919 X |
| 4,481,977 | 11/1984 | Maldavs | 220/229 X |
| 4,573,610 | 3/1986 | Hurner | 224/918 X |

*Primary Examiner*—Henry J. Recla
*Assistant Examiner*—Robert Petrik
*Attorney, Agent, or Firm*—Leon Gilden

[57] ABSTRACT

A portable ball caddy is set forth wherein a vertically oriented magazine tube is securable about the body of a user by a plurality of belts. The magazine is secured to the belts and is opaque except for an indicator slot formed therein to exhibit of the presence of balls therein. A spring loaded platform biases the balls towards an overlying exit formed of a flexible membrane of a memory retentent material. An opening is formed in the membrane of a diameter less than the diameter of the magazine tube and of the balls positionable therein. Formed on at least one diameter of said opening is an access relief enabling a user to position a finger therethrough for grasping of a ball adjacent the membrane thereunder.

1 Claim, 1 Drawing Sheet

BALL CADDY

BACKGROUND OF THE INVENTION

1. Field of the Invention

The present invention relates to ball holders and more particularly to tennis ball holders which are securable about a designated portion of the user thereof such as the waist. Ball holders of this class provide in magazine with ready supply of balls for utilization thereof.

2. Description of the Prior Art

The use of ball holders, and particularly tennis ball holders, is well known in the prior art. As may be appreciated, there devices have in the past been of cumbersome and awkward construction wherein an individual in utilization of these devices requires that access to a subsequent ball be of efficient and effective nature due to the character the sport or game such balls are utilized in. Magazines in the past have been encumbered by unnecessary mechanical or awkward features to resist the aforenoted desirable characteristics. For example, U.S. Pat. No. 1,810,491 to McClure sets forth the utilization of a spring biased golf ball holder wherein plural biased links on either side of an uppermost ball pivotally release said uppermost ball while constraining the ball immediately thereunder. While effective, the golf ball magazine in this case requires cumbersome and unnecessary construction adding to its weight and awkwardness, especially when used in sport where weight is a significant consideration.

U.S. Pat. No. 2,768,775 to Houser sets forth another ball holder, and particularly a golf ball holder, of bottom ejection type wherein a biased terminal opening at the exit thereof supports subsequent balls. This type of constricted opening effects an abrasion on ball surfaces and is of deleterious affect to such balls with an associated affect on the game itself. The shortcomings of such a device are quickly apparent.

U.S. Pat. No. 3,497,676 to Gravatt is another in a series of golf ball holders wherein the main thrust of this invention is to provide a heating element for warming of the balls secure therein ostensively for improved trajectory characteristics. The access to the holder itself is of an articulated nature wherein a user merely grasps either half of the container and pivots it for gaining access to the balls. It is thereby apparent that this particular magazine holder for balls fails to provide effective, efficient and quick access to such balls, as becomes necessary in a relative rapid game.

U.S. Pat. No. 4,042,156 to Knight sets forth a tennis ball carrier utilizing constricted openings enabling grasping of a tennis ball located therein. Constricted openings of this nature, while tending to scuff the ball itself, additionally tends to fatigue the materials forming the magazine resulting in limited life of such ball carriers.

U.S. Pat. No. 4,299,845 to Linzl sets forth another ball dispenser of gravity feed to a lowermost ejection port. Arcuate displaceable plates are positioned at the exit of the magazine holder to enable removal of sequential balls. The unnecessarily complex nature, as well as the other attendant shortcomings of this patent, are consistent with other prior devices including the notoriously well known use of constricted semi-rigid openings with their attendant shortcomings, as noted above.

As such, it may be appreciated that there is a continuing need for a new and improved magazine ball caddy which addresses both the problem of storage, portability, and affectiveness, and in this respect, the present invention substantially fulfills this need.

SUMMARY OF THE INVENTION

In view of the foregoing disadvantages inherent in the known types of ball caddies now present in the prior art, the present invention provides an ball caddy formed to vertically orient a plurality of spring biased balls towards an exit opening constricted by a flexible membrane formed of memory retentent materlal. Said memory retentent material is formed of a central opening and at least one and typically two relief openings formed along a diameter thereof to gain access to an uppermost ball. As such, the general purpose of the present invention, which will be described subsequently in greater detail, is to provide a new and improved ball caddy which has all the advantages of the prior art ball caddies and none of the disadvantages.

To attain this, the present invention comprises a tubular magazine formed with an internal spring biased platform to elevate a series positionable therein towards an exit membrane. The membrane is formed of any flexible and resilient memory retentent material and is further provided with a central substantially circular opening formed with at least one but preferably two reliefs formed along a common diameter thereof for finger access to an uppermost ball biased towards said membrane by a spring biased platform, as noted above. Said tubular magazine is securable about a preselected portion of a user by one or two straps, dependent on the degree of attachment desired. An indicator relief opening is positioned axially within a wall of said magazine for indication of the presence or absence of balls therein.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ball caddy which has all the advantages of the prior art ball caddies and none of the disadvantages.

It is another object of the present invention to provide a new and improved ball caddy which may be easily and efficiently manufactured and marketed.

It is a further object of the present invention to provide a new and improved ball caddy which is of a durable and reliable construction.

An even further object of the present invention is to provide a new and improved ball caddy which is susceptible of a low cost of manufacture with regard to both materials and labor, and which accordingly is then susceptible of low prices of sale to the consuming public, thereby making such ball caddies economically available to the buying public.

Still yet another object of the present invention is to provide a new and improved ball caddy which provides in the apparatuses and methods of the prior art some of the advantages thereof, while simultaneously overcoming some of the disadvantages normally associated therewith.

Still another object of the present invention is to provide a new and improved ball caddy formed of a tubular magazine with an indicator relief opening therein for sight indication of the presence or absence of balls within said magazine.

Yet another object of the present invention is to provide a new and improved ball caddy wherein a spring biased column of balls is biased towards an exit opening constricted by the presence of a membrane formed of memory retentent material.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
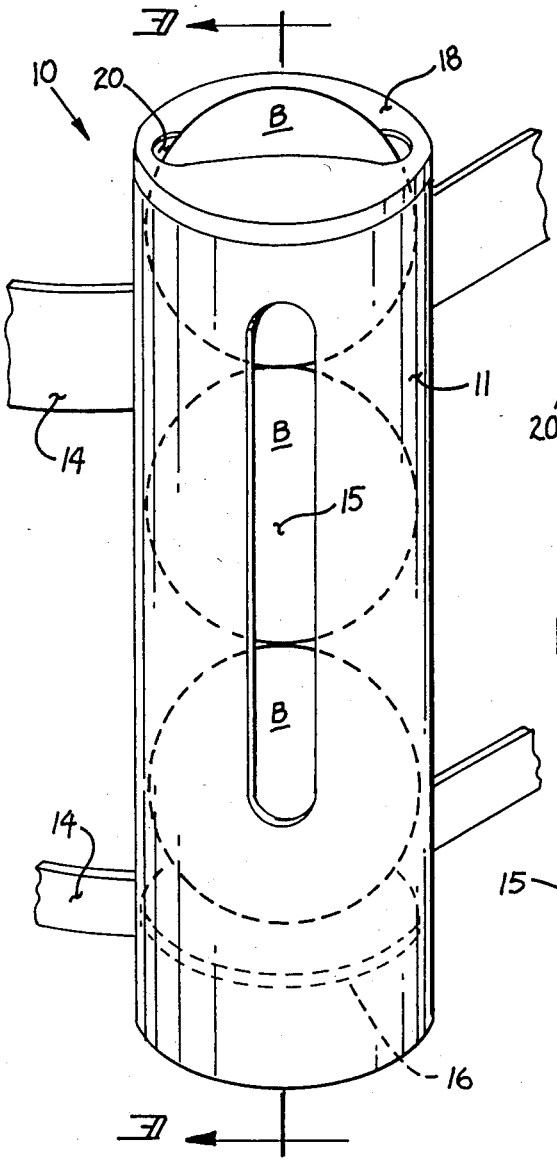
FIG. 1 is an isometric view of the present invention illustrating the various components and their inter-relationship.
Figure 2:
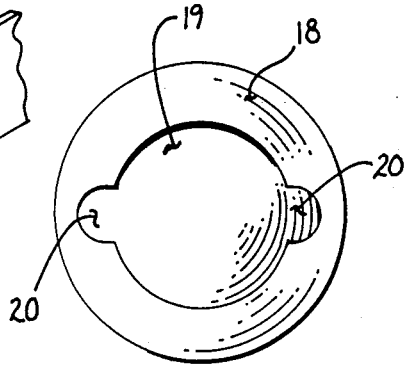
FIG. 2 is a top orthographic view of the invention illustrated in FIG. 1.
Figure 3:
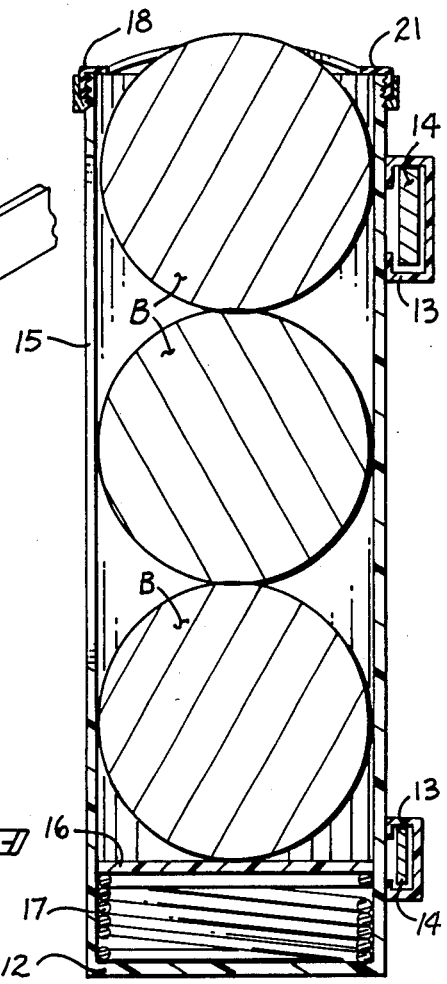
FIG. 3 is a side orthographic view taken along the lines 3—3 of FIG. 1 in the direction indicated by the arrows.

With reference now to the drawings, and in particular to FIG. 1 thereof, a new and improved ball caddy embodying the principles and concepts of the present invention and generally designated by the reference numeral 10 will be described.

More specifically it will be noted that the ball caddy apparatus 10 essentially comprises a tubular housing 11 formed with an integral bottom portion 12 and associated integral loop elements 18 spaced along tubular housing 11 to accept individual belt elements 14 for securement to a user of my invention. An axially oriented indicator relief opening 15 is positioned within wall surface of tubular housing 11 for "at a glance" indication of the presence or absence of balls therein. It may be appreciated that the apparatus 10 may be formed of varying diameters and lengths to accommodate a pre-determined diameter of ball according to the game associated therewith and of a length to accommodate a pre-determined number of such balls. Positioned within tubular housing 11 for biasing of the stacked column of balls therein is an elevator plate 16 formed with a captured coil spring 17 between elevator 16 and integral bottom portion 12. A coil spring is most easily adapted for use within the tubular housing but clearly various configurational biasing means may be utilized, either mechanical or pneumatic.

Positioned over the upper exit portion of my ball caddy 10 is a dispensing membrane 18 advantageously formed of any appropriate memory retentent resilient material including properties of expansion and contraction consistent with the instant invention. At least one access relief opening 20 is associated with a central opening 19 enabling a user to insert a finger through access relief opening 20 to grasp a ball "B" for removal through resilient memory retentent membrane 18. A plurality of access relief openings 20 are illustrated whereby most advantageously a user may insert a thumb and forefinger through respective openings 20 for grasping of an uppermost ball "B" and removal thereby through central opening 19 of membrane 18. Filling of tubular housing 11 is accomplished by merely inserting balls through opening 19 until housing 11 is full or alternatively as illustrated, membrane 18 may be integrally formed to a threaded annulus to engage companion threads formed on tubular housing 11 for filling of said housing.

As to the manner of usage and operation of the present invention, the same should be apparent from the above description. Accordingly, no further discussion relative the manner of usage and operation will be provided.

With respect to the above description then, it is to be realized that the optimum dimensional relationships for the parts of the invention, to include variations in size, materials shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ball magazine apparatus including means for attachment to an individual utilizing said apparatus comprising, a tubular magazine means including a closed first end and an open second end to define an exit opening, for housing a plurality of balls, and a biasing means for directing said balls towards an exit opening with a tubular magazine means, and resilient opening means positioned over said exit opening for enabling manual sequential grasping of said ball through said resilient opening means enabling removal of said balls from said magazine means, and said resilient opening means including a flexible membrane sheet securable over said exit opening, said membrane sheet formed with a central circular opening including a plurality of diametrically opposed relief opening for acceptance of an individual's fingers therethrough for grasping of an uppermost ball in said magazine means, the width of the opening defined by said relief openings and said central opening being less than that of said exit opening, and said biasing means includes a rigid planar elevator plate means positioned over said biasing means for upwardly biasing said balls to said exit opening, and said biasing means is captured between said first end and said elevator plate means, and wherein said means for attachment includes spaced integral loops secured to said tubular magazine means for acceptance of spaced belt means therethrough for securement about said individual, and wherein said central circular opening is of a diameter substantially less than that of said tubular magazine means, and wherein an indicator relief opening is axially oriented within a wall of said tubular magazine means for visual indication of the presence or absence of balls within said magazine means.

* * * * *